US010945490B2

(12) United States Patent
Daniels

(10) Patent No.: US 10,945,490 B2
(45) **Date of Patent: *Mar. 16, 2021**

(54) SHOE OUTSOLES AND SYSTEMS AND METHODS OF MANUFACTURING THE SAME

(71) Applicant: The Topline Corporation, Bellevue, WA (US)

(72) Inventor: Paul William Daniels, Issaquah, WA (US)

(73) Assignee: The Topline Corporation, Bellevue, WA (US)

( * ) Notice: Subject to any disclaimer, the term of this patent is extended or adjusted under 35 U.S.C. 154(b) by 110 days.

This patent is subject to a terminal disclaimer.

(21) Appl. No.: 16/241,528

(22) Filed: Jan. 7, 2019

(65) Prior Publication Data

US 2019/0133253 A1 May 9, 2019

Related U.S. Application Data

(60) Continuation of application No. 15/790,722, filed on Oct. 23, 2017, now Pat. No. 10,172,421, which is a (Continued)

(51) Int. Cl.
*A43B 13/22* (2006.01)
*A43D 95/06* (2006.01)

(Continued)

(52) U.S. Cl.
CPC ..... *A43B 13/22* (2013.01); *A43B 3/0084* (2013.01); *A43B 13/04* (2013.01); *A43D 25/181* (2013.01);

(Continued)

(58) Field of Classification Search
CPC ..... A43B 13/22; A43D 25/181; A43D 25/183
See application file for complete search history.

(56) References Cited

U.S. PATENT DOCUMENTS 2,663,097 A 12/1953 Giese, Jr.
4,899,411 A 2/1990 Johnson et al.

(Continued)

FOREIGN PATENT DOCUMENTS

WO 03/037128 5/2003

OTHER PUBLICATIONS

PCT Notification of Transmittal of the International Search Report and the Written Opinion of the International Searching Authority, or the Declaration dated Jul. 21, 2014 in corresponding International Application No. PCT/US2014/024577.

*Primary Examiner* — Robert A Vetere
(74) *Attorney, Agent, or Firm* — Amster, Rothstein & Ebenstein LLP

(57) ABSTRACT

Systems and methods of manufacturing a shoe outsole are provided wherein at least a portion of the resulting shoe outsole includes embedded particles. An example method includes applying adhesive to at least one region of the shoe outsole, depositing selected particles onto the adhesive to provide the shoe outsole with a first coat of particles, and at least partially curing the adhesive. The method continues by applying additional adhesive over the first coat of particles, depositing additional particles onto the adhesive to provide the shoe outsole with a second coat of particles, and at least partially curing the subsequent application of adhesive.

15 Claims, 2 Drawing Sheets

Related U.S. Application Data continuation of application No. 15/419,405, filed on Jan. 30, 2017, now Pat. No. 9,795,185, which is a division of application No. 14/206,436, filed on Mar. 12, 2014, now Pat. No. 9,591,886.

(60) Provisional application No. 61/785,283, filed on Mar. 14, 2013.

(51) Int. Cl.

| | |
|---|---|
| ***A43D 25/20*** | (2006.01) |
| ***A43B 13/04*** | (2006.01) |
| ***A43D 95/28*** | (2006.01) |
| ***A43D 25/18*** | (2006.01) |
| ***A43B 3/00*** | (2006.01) |
| ***A43D 111/00*** | (2006.01) |

(52) U.S. Cl.

CPC ..... *A43D 25/183* (2013.01); *A43D 25/20* (2013.01); *A43D 95/06* (2013.01); *A43D 95/28* (2013.01); *A43D 111/00* (2013.01)

(56) References Cited

U.S. PATENT DOCUMENTS

| | | | | |
|---|---|---|---|---|
| 6,430,844 | B1 | 8/2002 | Otis | |
| 7,056,558 | B2 | 6/2006 | Daniels et al. | |
| 7,191,549 | B2 | 3/2007 | Koo | |
| 7,516,506 | B2 | 4/2009 | Koo et al. | |
| 9,591,886 | B2 * | 3/2017 | Daniels | A43D 25/183 |
| 2004/0163283 | A1 * | 8/2004 | Daniels | A43B 13/22 36/59 R |
| 2004/0194345 | A1 | 10/2004 | Koo | |
| 2007/0079527 | A1 | 4/2007 | Daniels et al. | |

* cited by examiner

SHOE OUTSOLES AND SYSTEMS AND METHODS OF MANUFACTURING THE SAME

CROSS-REFERENCE TO RELATED APPLICATIONS

This application is a Continuation of U.S. patent application Ser. No. 15/790,722, filed Oct. 23, 2017 which is a Continuation of U.S. patent application Ser. No. 15/419,405, filed Jan. 30, 2017 (now U.S. Pat. No. 9,795,185) which is a Divisional of U.S. Pat. App. Ser. No. 14/206,436, filed Mar. 12, 2014 (now U.S. Pat. No. 9,591,886), which is claims the benefit of U.S. Provisional Pat. App. Ser. No. 61/785,283, filed Mar. 14, 2013 (now expired), the contents of each of which are hereby incorporated by reference herein.

This application is a divisional of U.S. patent application Ser. No. 14/206,436, filed Mar. 12, 2014, which claims priority of U.S. Provisional Application No. 61/785,283 filed Mar. 14, 2013.

BACKGROUND

Technical Field

This disclosure generally relates to footwear and, more particularly, to shoe outsoles including embedded particles and systems and methods of manufacturing the same for footwear.

Description of the Related Art

A variety of different methods for making shoe outsoles are known, such as, for example, injection molding. In addition, a variety of different systems and methods are known for providing outsoles with various surface characteristics. Examples of such systems and methods include molding fabric or other materials into the outsole and flocking the outsole with fabric fibers or other materials. Additional details of some known methods of providing outsoles with various surface characteristics can be found in U.S. Pat. Nos. 6,430,844; 7,056,558; 7,191,549; and 7,516,506, all of which are incorporated herein by reference in their entirety.

Existing systems and methods for producing outsoles with enhanced surface characteristics, however, may suffer from a variety of drawbacks or deficiencies. For example, some methods are overly cumbersome and/or time consuming. In addition, some methods fail to produce outsoles of sufficient durability or quality to meet or satisfy market needs.

BRIEF SUMMARY

Embodiments described herein provide systems and methods of manufacturing shoe outsoles for footwear wherein at least a portion of the shoe outsole includes embedded particles. The systems and methods are well adapted to produce shoe outsoles and resulting footwear that are particularly durable and of excellent quality. Moreover, the methods are particularly efficient and facilitate high production rates. Outsoles having embedded particles and footwear incorporating such outsoles are also provided.

In one embodiment, a method of manufacturing a shoe outsole may be summarized as including applying an initial application of adhesive to at least one region of a bottom side of a base of the shoe outsole such that at least a majority of a surface area of the bottom side of the base of the shoe outsole is covered with the adhesive, and depositing an initial application of a plurality of particles of a selected material that is different than a base material of the base of the shoe outsole onto the initial application of adhesive via electrostatic flocking to provide the shoe outsole with a first coat of particles. The method may continue with at least partially curing the initial application of adhesive such that the first coat of particles is at least partially embedded therein. Next, the method may proceed with applying a subsequent application of adhesive to the at least one region of the bottom side of the base of the shoe outsole over the first coat of particles and depositing a subsequent application of a plurality of particles onto the subsequent application of adhesive via electrostatic flocking to provide the shoe outsole with a second coat of particles in which at least some of the particles of the second coat overly particles of the first coat or are positioned within interstitial spaces thereof. The method may conclude with at least partially curing the subsequent application of adhesive such that the second coat of particles is at least partially embedded therein. In other instances, after at least partially curing the subsequent application of adhesive, the method may continue with applying a curing agent over the first and second coats of particles and curing the curing agent to firm the first and second coats of particles.

According to another embodiment, outsoles made according to aspects and principles of the manufacturing methods described herein may be summarized as including a base structure with a bottom side that defines a bottom surface area; a first layer of cured adhesive overlying at least one region of the bottom side of the base structure such that at least a majority of the bottom surface area is covered with the first layer of cured adhesive; a second layer of cured adhesive overlying the first layer of cured adhesive; and first and second pluralities of particles at least partially embedded in the first and second layers of the cured adhesive, respectively. Resulting outsoles made according to aspects and principles of the manufacturing methods described herein may be used to manufacture footwear having particularly advantageous surface characteristics, such as, for example, one or more textured surface areas characterized by embedded leather particles, or other desired particles. Particles of the textured surface areas may be distributed in a particularly dense and uniform manner and with a level of adhesion or a depth of embedment that enhances the durability of such areas.

DETAILED DESCRIPTION

In the following description, certain specific details are set forth in order to provide a thorough understanding of various disclosed embodiments. However, one of ordinary skill in the relevant art will recognize that embodiments may be practiced without one or more of these specific details. In other instances, well-known structures, systems and techniques associated with manufacturing outsoles and footwear may not be shown or described in detail to avoid unnecessarily obscuring descriptions of the embodiments. For example, it will be appreciated that the outsoles described herein may be combined with other footwear components, such as, for example, shoe uppers, to produce a variety of different types and styles of footwear including, among others, loafers, oxfords, boots and canvas shoes.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide systems and methods of manufacturing shoe outsoles for footwear wherein at least a portion of the shoe outsole includes particles embedded therein. The systems and methods are well adapted to produce shoe outsoles with textured surface areas that are particularly durable and exhibit exceptional quality. Moreover, the methods are particularly efficient and enable high production rates.

Figure 1:
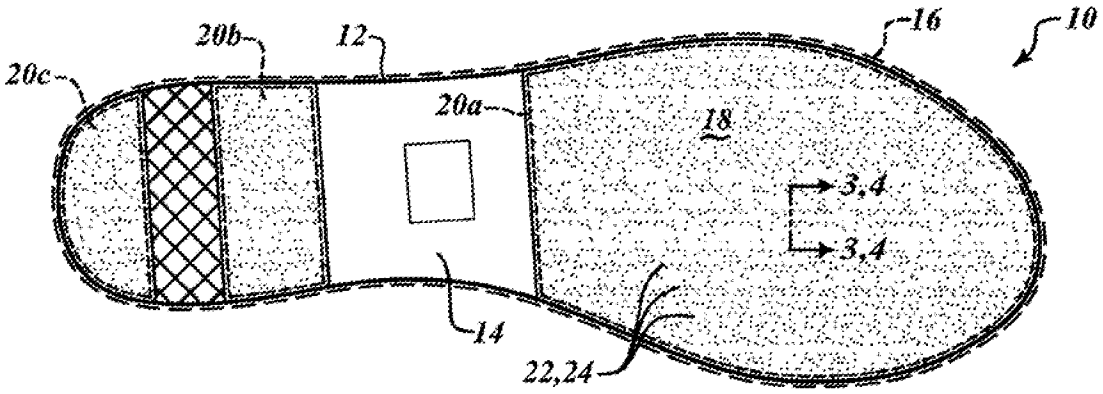
FIG. 1 is a bottom view of a shoe outsole, according to one embodiment.

FIG. 1 shows a shoe outsole 10 manufactured according to aspects of the methods described herein. The shoe outsole 10 includes a base component 12 having a bottom side 14 for engaging the ground when the outsole 10 is incorporated into footwear. A perimeter 16 of the bottom side 14 of the shoe outsole 10 defines a bottom surface area 18. At least a majority of the bottom surface area 18 is covered with one or more textured surface areas 20*a*-20*c* provided by at least partially overlapping coats of particles 22, 24 adhered to the base component 12.

Figure 2:
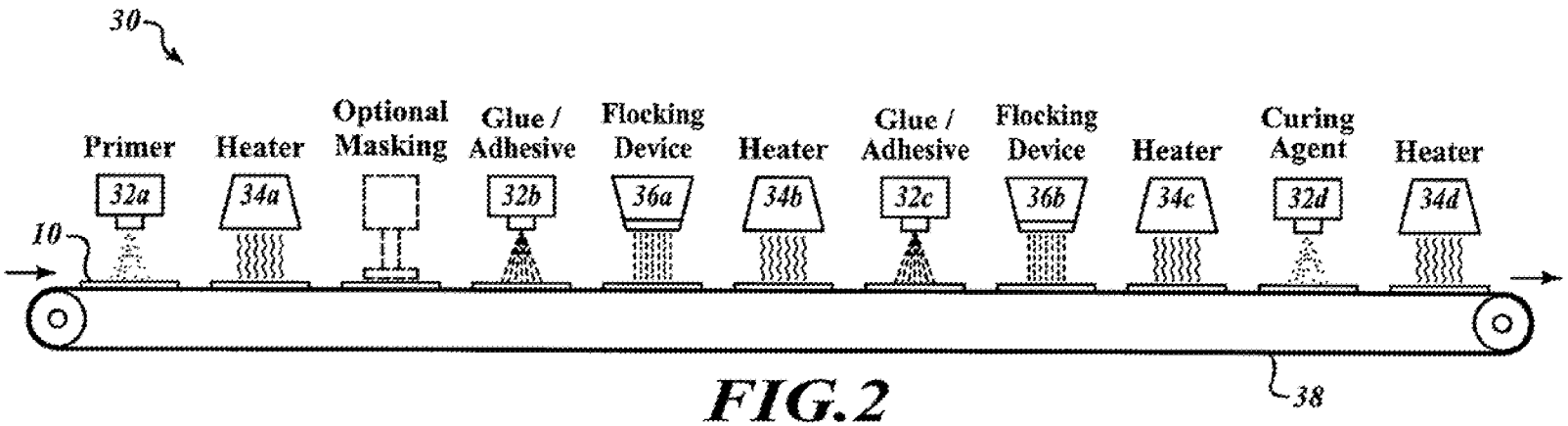
FIG. 2 is a side view schematically illustrating a method of manufacturing outsoles, according to one embodiment.

FIG. 2 schematically illustrates an example system 30 and associated method of manufacturing shoe outsoles for footwear wherein at least a portion of the shoe outsole has particles embedded therein. The system 30 is depicted as a continuous manufacturing line for illustrative purposes; however, it is appreciated that steps or aspects of the methods described herein may be carried out intermittently or in stages. In addition, in some instances, steps or aspects of the methods may be carried out manually.

The system 30 may comprise one or more spray applicators 32*a*-32*d* for applying various substances to outsoles, such as, for example, various primers, adhesives and curing agents. The system 30 may further comprise one or more heaters 34*a*-34*d* for curing adhesives or otherwise subjecting outsoles and substances applied thereto to an environment having an elevated temperature. Still further, the system may comprise one or more flocking devices 36*a*, 36*b*, such as, for example, electrostatic flocking and spray flocking devices, or other devices, such as, for example, sifting devices for depositing selected particles onto the outsoles. A conveyor system 38 or other support structure may be provided to transport outsoles in a batch or a continuous manner throughout the manufacturing process or portions thereof. In embodiments featuring electrostatic flocking, the conveyor system 38 or other support system may include features for grounding the same.

With reference to FIGS. 1 and 2, a method of manufacturing shoe outsoles for footwear wherein at least a portion of the shoe outsole 10 has particles 22, 24 embedded therein may begin with providing a base component 12 of an outsole 10 comprising one or more base materials, such as, for example, fiber reinforced composite material, polyvinyl chloride (PVC), thermoplastic rubber (TPR), rubber and ethylene vinyl acetate (EVA). The base component 12 may be formed by a variety of different techniques, including conventional techniques used to form outsoles, such as, for example, injection molding. The base component 10 may have a bottom side 14 having a perimeter 16 that defines a bottom surface area 18. The bottom side 14 may be relatively flat or may include various peaks, valleys, protrusions or other structures, and may have no tread, light tread or heavy tread. It is appreciated that aspects of the methods described herein may apply to a wide variety of shoe outsoles 10 irrespective of the particular surface configuration thereof.

After providing the base component 12, the method may continue with applying a primer to at least a portion of the bottom surface area 18 of the base component 12. The primer may be, for example, a primer comprising principally acetone and cyclohexane, or other suitable primers. In some instances, primer may be applied to the entire bottom surface area 18 of the base component 12. In other instances, only selected regions that are to be subjected to further processing may be applied with the primer. The primer may be applied with a spray apparatus (e.g., a spray nozzle, spray gun), a brush, a roller, a cloth or other suitable devices.

After the primer is applied to base component 12 of the outsole 10, the base component 12 may be subjected to an environment characterized by an elevated temperature. In some embodiments, the environment may be characterized by an elevated temperature in a range of about 45'C to about 60° C., and more preferably an elevated temperature in a range of about 50° C. to about 55° C. The base component 12 may be retained within the heated environment for a short heating period such as, for example, at least forty-five seconds but less than three minutes, and more preferably at least about one minute but less than about two minutes. In some embodiments, the base component 12 may be subjected to an elevated temperature in a range of about 50° C. to about 55° C. for about one minute.

Next, the method may continue with applying an initial application of adhesive to at least one region of the bottom side 14 of the base component 12, and preferably such that at least a majority of the bottom surface area 18 of the bottom side 14 of the base component 12 is covered with the adhesive. The adhesive may be, for example, a styrene based adhesive having a pH of about 4.5-6.5 and a viscosity of about 25,000-30,000 cps or other suitable adhesive. In some instances, the entire bottom surface area 18 of the base component 12 may be covered with the adhesive. In other instances, one or more distinct regions of the bottom surface area 18 may be covered with the adhesive while other regions remain void of the adhesive. In such cases, one or more mask elements (not shown) may be secured to the bottom side 14 of the base component 12 to prevent any adhesive from being applied to those portions of the bottom surface area 18 underlying the one or more mask elements. The adhesive may be applied with a spray apparatus (e.g., a spray nozzle, spray gun), a brush, a roller, a cloth or other suitable devices.

Next, the method may continue with depositing an initial application of a plurality of selected particles 22 onto the initial application of adhesive to provide the shoe outsole with a first coat of particles 22. It will be appreciated that in embodiments wherein one or more masks are used in applying the adhesive, the particles will be deposited in one or more distinct regions adjacent to such mask(s). The particles 22 may comprise pulverized or ground leather particles or other particles that are different from the base material or materials of the base component 12 to provide contrast thereto. Other example particles may include, for example, textile particles, such as, for example, rayon or nylon fibers or other natural or synthetic fibers.

The particles 22 may be deposited onto the adhesive via a flocking process, such as, for example, an electrostatic flocking or spray flocking process. In other instances, the particles may be sifted, manually or automatically, onto the adhesive applied to the bottom side 14 of the base component 12. Preferably, an electrostatic flocking process is used which is inclusive of a screening process to control the particle size of the matter deposited onto the base component 12. In some embodiments, for example, an electrostatic flocking apparatus may comprise a screen or net element that blocks particles 22 greater than a threshold size from being deposited onto the base component 12 of the shoe outsole 10. For example, the particles 22 may be screened or otherwise filtered such that a major dimension of each particle 22 deposited on the base component 12 is less than a threshold size of about 2 mm in some embodiments, or less than about 1 mm or about 500 pm in other embodiments.

After the first coat of particles 22 is deposited onto the adhesive, the method may continue by at least partially curing the initial application of adhesive such that the first coat of particles 22 is at least partially embedded therein. Curing may occur by subjecting the base component 12 with the embedded particles 22 to an environment characterized by an elevated temperature. In some embodiments, the environment may be characterized by an elevated temperature in a range of about 45° C. to about 60° C., and preferably in a range of about 50° C. to about 55° C. The base component 12 may be retained within the heated environment for a short heating period such as, for example, at least forty-five seconds but less than three minutes, and preferably at least about one minute but less than about two minutes. In some embodiments, the base component 12 may be subjected to an elevated temperature in a range of about 50° C. to about 55° C. for about one minute. Upon at least partial curing, the first coat of particles 22 may be described as being integrally formed or secured to the base component 12. At this stage, the particles 22 may be generally uniformly distributed over the applied regions 20*a*-20*c* of the bottom surface area 18. The application of particles 22 may be such that the particles 22 are relatively densely packed, however, interstitial spaces may nevertheless remain between the particles 22 of the first coat.

Next, a subsequent application of adhesive may be applied to at least one region of the bottom side 14 of the base component 12 over the first coat of particles 22 adhered thereto. It will be appreciated that in embodiments wherein one or more masks are used in applying the initial application of adhesive, the mask(s) may be maintained over the same area(s) of the bottom side 14 of the base component 12 of the shoe outsole 10 while depositing the initial application of the particles 22 of the first coat and while applying the subsequent application of adhesive. In other instances, the one or more masks may be removed or relocated such that the subsequent application of adhesive overlaps with but is not coextensive with the area(s) of the bottom side 14 of the base component 12 with the adhered particles 22 of the first coat. This can facilitate the fabrication of overlapping textured areas having different particle densities or other differing characteristics, such as different sizes, different colors, different textures, etc.

The subsequent application of adhesive may fill in interstitial spaces between the particles 22 of the first coat and in some instances may provide a layer of adhesive that completely covers at least some of the particles 22 of the first coat. In some cases, the particles 22 of the first coat adhered to the base component 12 may protrude through the adhesive of the subsequent application. Again, adhesive may be applied with a spray apparatus (e.g., a spray nozzle, spray gun), a brush, a roller, a cloth or other suitable devices.

After the subsequent application of adhesive is applied, the method may continue with depositing a subsequent application of particles 24 onto the adhesive to provide the shoe outsole 10 with a second coat of particles 24. At least some of the particles 24 of the second coat may overlie particles 22 of the first coat and at least some of the particles 24 of the second coat may be positioned within interstitial spaces between particles 22 of the first coat. Again, the particles 24 may comprise pulverized or ground leather particles or other particles that are different from the base material or materials of the base component 12 to provide contrast thereto. Other example particles may include, for example, textile particles, such as, for example, rayon or nylon fibers or other natural or synthetic fibers.

The particles 24 of the second coat may be of the same type or of a different type of the particles 22 of the first coat The particles 24 may be deposited onto the adhesive via a flocking process, such as, for example, an electrostatic flocking or spray flocking process. In other instances, the particles 24 may be sifted, manually or automatically, onto the adhesive over the first coat of particles 22. Preferably, an electrostatic flocking process is used which is inclusive of a screening process to control the particle size of the matter deposited onto the base component 12. In some embodiments, for example, an electrostatic flocking apparatus may comprise a screen or net element that blocks particles greater than a threshold size from being deposited onto the base component 12 of the shoe outsole 10. For example, the particles 24 may be screened or otherwise filtered such that a major dimension of each of the particles 24 deposited on the base component 12 is less than a threshold size of about 2 mm in some embodiments, or less than about 1 mm or about 500 pm in other embodiments. The same threshold size may be used for screening the second coat of particles 24 onto the base component 12 as that which was used in screening the first coat of particles 22.

After the second coat of particles 24 is deposited onto the adhesive, the method may continue by at least partially curing the subsequent application of adhesive such that the particles 24 of the second coat are at least partially embedded therein. Curing may occur by subjecting the base component 12 with the embedded particles 24 of the second coat to an environment characterized by an elevated temperature. In some embodiments, the environment may be characterized by an elevated temperature in a range of about 45° C. to about 60° C., and preferably in a range of about 50° C. to about 55° C. The base component 12 may be retained within the heated environment for a short heating period such as, for example, at least forty-five seconds but less than three minutes, and preferably at least about one minute but less than about two minutes. In some embodiments, the base component 12 may be subjected to an elevated temperature in a range of about 50° C. to about 55° C. for about one minute.

Upon at least partial curing, the second coat of particles 24 may be described as being integrally formed or secured to the base component 12. At this stage, the particles 22, 24 of the first coat and the second coat may be generally uniformly distributed over the applied regions 20*a*-20*c* of the bottom surface area 18 with the interstitial spaces of the particles 22 of the first coat being substantially filled. Moreover, the effective depth D of the adhered particles 22, 24 is significantly increased as a result of the dual coating procedure, thereby increasing the durability and longevity of the treated areas of the shoe outsole 10. Although it is contemplated that additional coats of particles can be applied in a similar manner, the additional benefits of doing so may diminish with each coat applied and may be offset by productivity losses arising from the time required to form such additional coats or layers. Accordingly, a dual layered structure may be preferred.

In any event, after the second coat or final coat of particles is applied, and after at least partially curing of the adhesive underlying the same, a curing agent may be applied over the built-up coats or layers of particles 22, 24 of the shoe outsole 10 and then cured to firm the same for subsequent handling of the shoe outsole 10 and fabrication of footwear comprising the same. The curing agent may be, for example, a styrene based curing agent having a pH of about 7-8 and a viscosity less than 100 cps, or other suitable curing agent.

The methods of manufacturing shoe outsoles 10 described herein may be carried out in a continuous or batch manufacturing process. In this regard, various known conveyor systems 38, support devices or other structures may be used to transport the base component 12 of the outsole 10, as well as other similar base components 12, between and/or among various stations to complete one or more of the steps or stages of the disclosed manufacturing methods. In some embodiments, conveying or transporting the base component 12 of the shoe outsole 10 may be carried out in such a manner that applying the initial application of adhesive, depositing the initial application of particles 22 of the first coat, at least partially curing the initial application of adhesive, applying the subsequent application of adhesive, depositing the subsequent application of the particles 24 of the second coat, and at least partially curing the subsequent application of adhesive occurs sequentially and preferably in rapid succession.

Although FIG. 2 illustrates a system having four separate spray applicators 32*a*-32*d* for applying various substances to outsole components, four separate heaters 34*a*-34*d* for curing adhesives or otherwise subjecting outsole components and substances applied thereto to a heated environment, and two flocking devices 36*a*, 36*b* for depositing selected particles 22, 24 onto the outsole base component 12, it is appreciated that in some embodiments the system may comprise fewer and/or different fluid applicators, fewer and/or different heating devices and fewer and/or different particle depositing devices than those illustrated, and that steps of the manufacturing methods described herein may be performed by moving the base component 12 of the outsole 10 or groups thereof back and forth between or among such equipment or different equipment. For example, in some embodiments, a single heating unit may be provided for carrying out each of heating and curing steps of the methods described herein. Accordingly, the systems and methods described herein are not limited to the apparatuses and arrangement of apparatuses shown in FIG. 2. Rather, a wide range of devices may be used to apply the various substances and particles onto the outsoles, such as, for example, brushes, rollers, or other suitable devices. In addition, handheld applicators, such as, for example handheld spray applicators and the like may be used in place of larger machine installations. Still further, it is appreciated that the base component 12, and like components, may remain stationary throughout all or some of the steps of the methods described herein.

Figure 4:
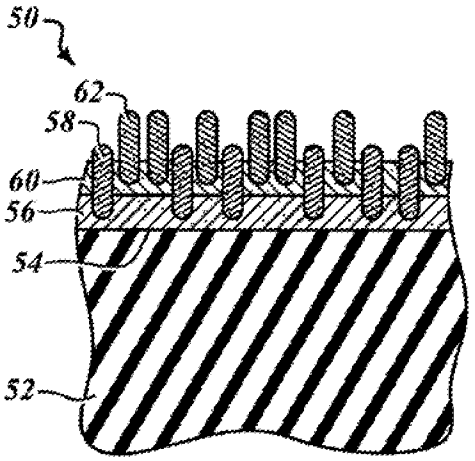
FIG. 4 is a partial cross-sectional view illustrating a structure of an outsole, according to another embodiment, manufactured according to aspects of the methods described herein.
Figure 3:
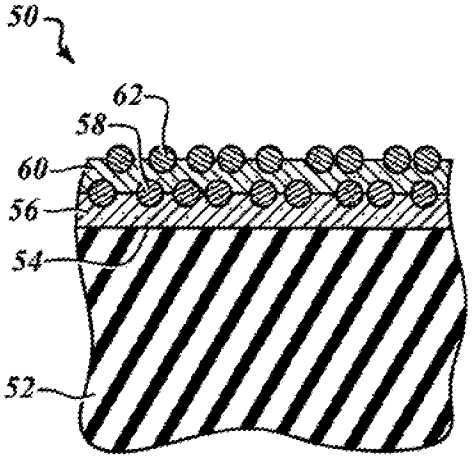
FIG. 3 is a partial cross-sectional view illustrating a structure of an outsole, according to one embodiment, manufactured according to aspects of the methods described herein.

Accordingly, a variety of different systems and arrangements may be used to manufacture shoe outsoles having a unique makeup including one or more textured surface areas 20*a*-20*c*. FIGS. 3 and 4 show partial cross-sectional views that schematically illustrate the makeup or structural features of shoe outsoles manufactured according to embodiments of the methods described herein. More particularly, FIG. 3 shows a shoe outsole having multiple layers of generally uniform, ground or pulverized particles embedded therein, while FIG. 4 shows a shoe outsole having multiple layers of generally uniform, fibers or filaments embedded therein.

With continued reference to FIGS. 3 and 4, a shoe outsole 50 resulting from methods described herein, or variations thereof, may include a base component 52 comprising a base material, such as, for example, fiber reinforced composite material, polyvinylchloride (PVC), thermoplastic rubber (TPR), or rubber and ethylene vinyl acetate (EVA). A bottom side 54 of the base component 52 may be covered by a first cured adhesive layer 56 having a plurality of particles 58 at least partially embedded therein and a second cured adhesive layer 60 at least partially covering the first cured adhesive layer 56. Additionally, in some instances, the second cured adhesive layer 60 may also completely cover at least some of the particles 58 embedded in the first cured adhesive layer 56, as illustrated, for example, in FIG. 3. Additional particles 62 may be at least partially embedded in the second cured adhesive layer 60. The particles 58, 62 of each coat or layer preferably comprise a material that is different from a material of the base component 52. In some embodiments, the particles 58, 62 may be pulverized or ground leather. In other embodiments, the particles 58, 62 may be textile particles, such as, for example, rayon or nylon fibers or other natural or synthetic fibers.

Some of the particles 62 that are at least partially embedded in the second cured adhesive layer 60 may overlie respective particles 58 embedded in the first cured adhesive layer 56. In addition, some of the particles 62 that are at least partially embedded in the second cured adhesive layer 60 may be positioned at least partially within interstitial spaces 64 between respective groups or clusters of the particles 58 embedded in the first cured adhesive layer 56. Advantageously, some particles 58, 62 embedded in the resultant shoe outsole 10 may be partially exposed to the external environment while other particles 58 may be at least initially covered by a portion of the outer adhesive layer 60. In this manner, some particles 58 may become exposed only as the outsole 50 is worn. This may lead to increased durability and longevity of the textured areas of the shoe outsole 50.

Although some features shown in FIGS. 3 and 4 are drawn as distinct layers, it is appreciated that the layers of the outsole structure 50 may migrate or diffuse into adjacent layers during the manufacturing process. Thus, there may not be a clear demarcation between the adjacent layers of cured adhesive 56, 60 or the adjacent coats or layers of particles 58, 62. In addition, although the particles 58, 62 are illustrated as having a generally uniform size and shape, each particle may vary in size and shape from the next and may take on a variety of regular and irregular forms. Moreover, the structures in FIGS. 3 and 4 are exaggerated for purposes of illustration, and it is appreciated that particles 58, 62 in the actual structures may be closely packed and appear as a generally uninterrupted layer.

Moreover, the various embodiments described above can be combined to provide further embodiments. All of the U.S. patents referred to in this specification are incorporated herein by reference, in their entirety. Aspects of the embodiments can be modified, if necessary, to employ concepts of the various patents to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of manufacturing a shoe outsole, the method comprising:

applying an initial application of adhesive to at least a portion of a bottom side of a base of the shoe outsole such that at least a portion of a surface area of the bottom side of the base of the shoe outsole is covered with the adhesive;

depositing an initial application of a plurality of particles of a selected material onto the initial application of adhesive via electrostatic flocking to provide the shoe outsole with a first coat of particles;

at least partially curing the initial application of adhesive such that the first coat of particles is at least partially embedded therein;

applying a subsequent application of adhesive to the at least one region of the bottom side of the base of the shoe outsole over the first coat of particles; and depositing a subsequent application of a plurality of particles onto the subsequent application of adhesive to provide the shoe outsole with a second coat of particles.

2. The method of claim 1, wherein the first and second plurality of particles comprise a material that is different than a material of the base.

3. The method of claim 1, wherein at least some of the second plurality of particles embossed in the second layer of adhesive at least partially overlie respective particles of the first plurality of particles.

4. The method of claim 1, wherein at least some of the second plurality of particles embedded in the second layer of adhesive are positioned at least partially within interstitial spaces between the first plurality of particles.

5. The method of claim 1, further comprising:

prior to applying the initial application of adhesive, applying a primer to at least a portion of the bottom side of the base of the shoe outsole; and heating the base of the shoe outsole applied with the primer.

6. The method of claim 1, further comprising:

after depositing the subsequent application of the plurality of particles, curing the subsequent application of adhesive such that the second coat of particles is at least partially embedded therein.

7. The method of claim 6, wherein the step of at least partially curing the subsequent application of adhesive includes exposing the shoe outsole to an environment having an elevated temperature in a range of about 50° C. to about 55° C. for at least one minute.

8. The method of claim 1, wherein the step of at least partially curing the initial application of adhesive includes exposing the shoe outsole to an environment having an elevated temperature in a range of about 50° C. to about 55° C. for at least one minute.

9. The method of claim 1, wherein the selected material is pulverized leather.

10. The method of claim 1 wherein the steps of depositing the initial application of the particles of the first coat and depositing the subsequent application of the particles of the second coat each include screening the particles with a screen such that a major dimension of each of the particles deposited on the shoe outsole is less than a threshold size corresponding to a pore size of the screen.

11. The method of claim 10 wherein screening the particles includes screening the particles such that the major dimension of each of the particles deposited on the shoe outsole is less than 2 mm.

12. The method of claim 1, further comprising:

conveying the base of the shoe outsole to a plurality of devices in a manner such that the steps of applying the initial application of adhesive, depositing the initial application of particles of the first coat, at least partially curing the initial application of adhesive, applying the subsequent application of adhesive, and depositing the subsequent application of the particles of the second coat occur sequentially.

13. A method of manufacturing a shoe outsole, the method comprising:

applying an initial application of adhesive to at least one region of a bottom side of a base of the shoe outsole such that at least a portion of a surface area of the bottom side of the base of the shoe outsole is covered with the adhesive;

depositing an initial application of a plurality of pulverized leather particles onto the initial application of adhesive to provide the base of the shoe outsole with a first coat of pulverized leather particles;

at least partially curing the initial application of adhesive such that the first coat of pulverized leather particles is at least partially embedded therein;

applying a subsequent application of adhesive to the at least one region of the bottom side of the base of the shoe outsole over the first coat of pulverized leather particles; and depositing a subsequent application of a plurality of pulverized leather particles onto the subsequent application of adhesive to provide the base of the shoe outsole with a second coat of pulverized leather particles, at least some of the pulverized leather particles of the second coat overlying pulverized leather particles of the first coat, and at least partially curing the subsequent application of adhesive such that the second coat of pulverized leather particles is at least partially embedded therein.

14. The method of claim 13, further comprising:

prior to applying the initial application of adhesive, applying a primer to at least a portion of the bottom side of the base of the shoe outsole; and heating the base applied with the primer.

15. The method of claim 13, further comprising:

after at least partially curing the subsequent application of adhesive such that the second coat of pulverized leather particles is at least partially embedded therein, applying a curing agent over the first and second coats of pulverized leather particles; and curing the curing agent to firm the first and second coats of pulverized leather particles.

* * * * *